US006726503B2

(12) United States Patent
Waddell et al.

(10) Patent No.: US 6,726,503 B2
(45) Date of Patent: Apr. 27, 2004

(54) ELECTRICAL CONNECTOR WITH WIRE MANAGEMENT MODULE

(75) Inventors: Kent D. Waddell, Co Clare (IE); Peter Curtin, Clare (IE); Eugene Folan, Galway (IE); John M. Horgan, Limerick (IE); Enda Kelly, Kilshanny (IE); Joseph McCarthy, Cappamore (IE); John Meaney, Clare (IE); Brian Murphy, Limerick (IE); John Wallace, Limerick (IE); Michael J. Miskin, Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/177,509

(22) Filed: Jun. 21, 2002

(65) Prior Publication Data

US 2003/0236021 A1 Dec. 25, 2003

(51) Int. Cl.[7] ..... H01R 13/58

(52) U.S. Cl. ..... 439/465; 439/497; 439/731; 439/752; 439/941; 439/608; 439/695; 439/686; 439/472; 439/719

(58) Field of Search ..... 439/465, 460, 439/457, 941, 731, 752, 719, 497, 492, 499, 470, 472, 686, 687, 695, 696, 608

(56) References Cited

U.S. PATENT DOCUMENTS

| | | | | | |
|---|---|---|---|---|---|
| 4,029,896 | A | | 6/1977 | Skinner | 174/138 F |
| 4,083,615 | A | * | 4/1978 | Volinskie | 439/402 |
| 4,448,474 | A | | 5/1984 | Melnychenko | 339/103 |
| 4,602,830 | A | | 7/1986 | Lockard | 439/108 |
| 4,655,515 | A | | 4/1987 | Hamsher, Jr. et al. | 439/108 |
| 4,690,647 | A | | 9/1987 | Hamsher, Jr. et al. | 439/92 |
| 4,715,827 | A | * | 12/1987 | Furman | 439/465 |
| 4,852,252 | A | | 8/1989 | Ayer | 29/860 |
| 4,879,809 | A | | 11/1989 | Nicholas et al. | 29/860 |
| 4,993,968 | A | | 2/1991 | Guletsky et al. | 439/492 |
| 5,569,050 | A | * | 10/1996 | Lloyd | 439/465 |
| 5,713,126 | A | | 2/1998 | Sakemi | 29/843 |
| 5,823,825 | A | | 10/1998 | Murphy | 439/610 |
| 5,850,692 | A | | 12/1998 | Schock et al. | 29/861 |
| 5,899,770 | A | * | 5/1999 | Ezawa | 439/418 |
| 6,039,611 | A | | 3/2000 | Yang | 439/701 |
| 6,042,427 | A | * | 3/2000 | Adriaenssens et al. | 439/676 |
| 6,093,046 | A | * | 7/2000 | Chiou et al. | 439/378 |
| 6,139,372 | A | | 10/2000 | Yang | 439/701 |
| 6,179,671 | B1 | * | 1/2001 | Ohsumi | 439/752 |
| 6,206,722 | B1 | | 3/2001 | Ko et al. | 439/417 |
| 6,280,209 | B1 | | 8/2001 | Bassler et al. | 439/101 |
| 6,293,829 | B1 | * | 9/2001 | Qiao et al. | 439/719 |
| 6,296,530 | B1 | * | 10/2001 | Yoneda et al. | 439/701 |
| 6,482,028 | B2 | * | 11/2002 | Kumamoto et al. | 439/498 |

* cited by examiner

*Primary Examiner*—P. Austin Bradley
*Assistant Examiner*—Truc Nguyen
(74) *Attorney, Agent, or Firm*—Stephen Z. Weiss

(57) ABSTRACT

An electrical connector assembly is provided for terminating a plurality of electrical wires. A non-conductive connector housing mounts a plurality of signal terminals. A wire management module includes a non-conductive body mounting a plurality of ground terminals. The body positions a plurality of signal conductors and a plurality of ground conductors of the electrical wires, the ground conductors being terminated to the ground terminals. The ground terminals interengage with the connector housing to mount the wire management module to the housing with the signal wire conductors in position for termination to the signal terminals.

12 Claims, 2 Drawing Sheets

ELECTRICAL CONNECTOR WITH WIRE MANAGEMENT MODULE

FIELD OF THE INVENTION

This invention generally relates to the art of electrical connectors and, particularly, to an electrical connector assembly for terminating a plurality of electrical wires and including a wire management module to facilitate positioning the wires for termination.

BACKGROUND OF THE INVENTION

Electrical connectors typically include some form of insulating or dielectric housing for mounting a plurality of conductive terminals. In some connectors, the terminals are terminated or connected directly to various electronic devices such as printed circuit boards. In other connectors, the terminals are terminated to discrete electrical wires which lead or couple the connector in a particular electrical system.

In connecting or terminating the terminals of an electrical connector to discrete electrical wires, problems constantly are encountered in positioning the wires for proper termination. This is particularly true with the ever-increasing miniaturization and density of contemporary electrical connectors. Consequently, various wire management systems have been designed to receive and position the electrical wires for termination to the connector terminals.

One type of wire management system uses a wire management member or component which is molded integrally with the connector housing. Such systems cause considerable and sometimes impossible molding problems. Other wire management systems use wire management members which are separate from the connector housing but are attached thereto by some form of mounting means. Unfortunately, the mounting means often take up valuable space or "real estate" on the connector which is undesirable with miniaturized or high density connectors.

By mounting the wire management module to the housing by using some of the terminals, the exposed conductors are more accurately located in relation to the rear portion of the terminals. Also, force on the cable does not pass through the completed joint between the wire conductor and the respective terminal. Finally, this arrangement provides space above the area between the wire conductor and the respective terminal. This space provides access to the appropriate device needed to create the electrical joint.

The present invention is directed to solving, these various problems by providing a new and improved system wherein a wire management module is mounted to a connector housing by at least some of the terminals, themselves, which are used in the connector assembly. This avoids the molding problems of the integral wire management system and the space problems of the separate wire management systems.

SUMMARY OF THE INVENTION

An object, therefore, of the invention is to provide a new and improved electrical connector assembly for terminating a plurality of electrical wires.

In the exemplary embodiment of the invention, the connector assembly include a dielectric connector housing mounting a plurality of first conductive terminals. A wire management module includes a dielectric body mounting a plurality of second conductive terminals. Wire retainer means are provided on the body for positioning a plurality of first electrical wires and a plurality of second electrical wires for termination to the second conductive terminals. Complementary interengaging mounting means are provided between the connector housing and the second conductive terminals for mounting the wire management module to the connector housing with the first electrical wires in position for termination to the first conductive terminals.

As disclosed herein, the first conductive terminals are signal terminals and the second conductive terminals are ground terminals. The connector housing includes a plurality of terminal-receiving slots into which the second conductive terminals are press-fit to mount the wire management module to the connector housing.

According to an aspect of the invention, the dielectric body of the wire management module is a two-part structure which clamps the electrical wires therebetween. The two parts of the dielectric body also clamp the second conductive terminals therebetween. The two parts of the body include opposing grooves for positioning the electrical wires therebetween. The second conductive terminals are stamped metal components and include T-shaped sections defining opposing ears interengaged in slots in the two parts of the dielectric body.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE EMBODIMENT

Figure 1:
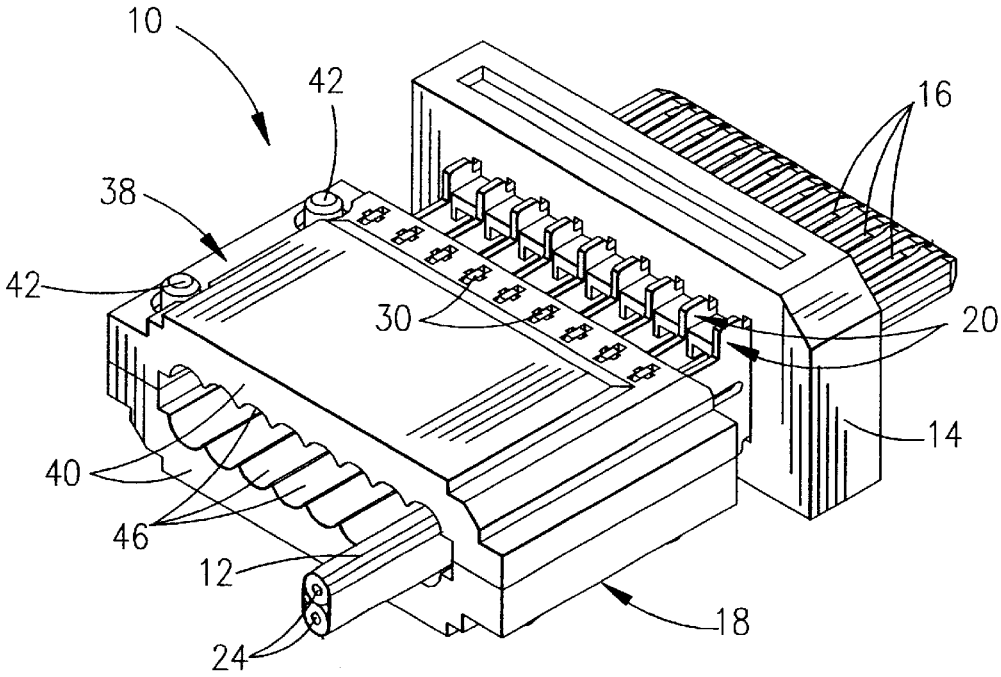
FIG. 1 is a rear perspective view of an electrical connector assembly incorporating the wire management module of the invention.
Figure 2:
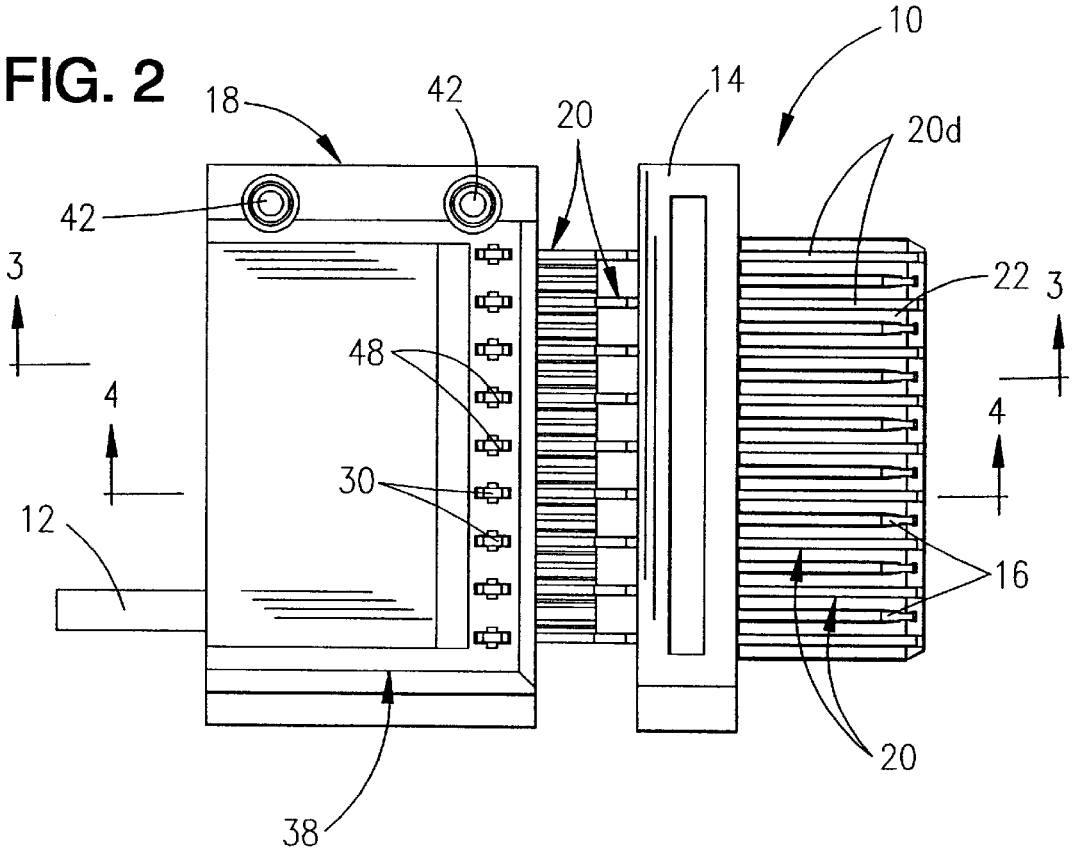
FIG. 2 is a top plan view of the connector assembly.

Referring to the drawings in greater detail, and first to FIGS. 1 and 2, the invention is embodied in an electrical connector assembly, generally designated 10, for terminating a plurality of electrical wires 12. Only one electrical wire is shown in the drawings. The connector assembly includes a dielectric or non-conductive connector housing 14 which mounts a plurality of first or signal terminals 16. A wire management module, generally designated 18, mounts a plurality of second or ground terminals, generally designated 20. According to the invention, wire management module 18 is mounted to the rear of connector housing 14 by the use of ground terminals 20, as will be seen hereinafter.

Figure 3:
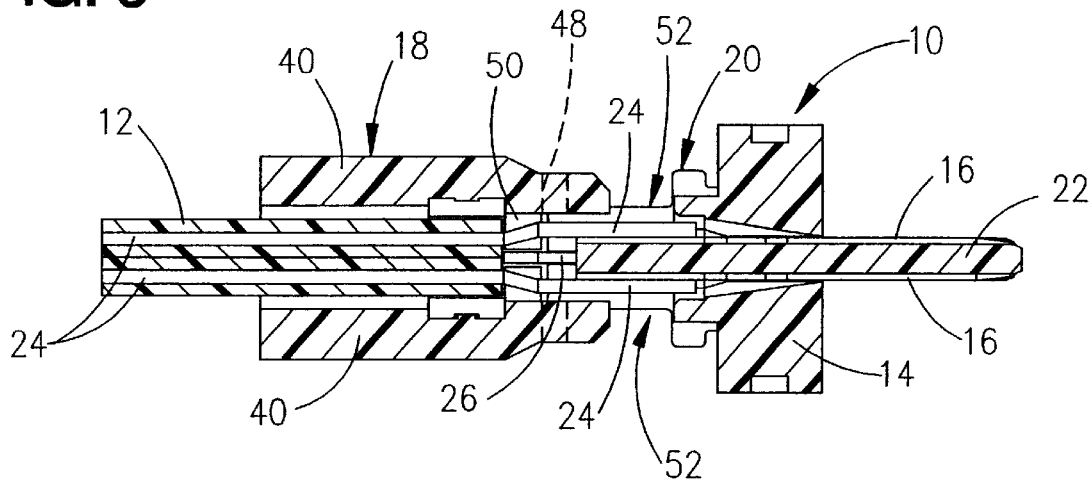
FIG. 3 is a vertical section taken generally along line 3—3 of FIG. 2.

Referring to FIG. 3 in conjunction with FIGS. 1 and 2, first or signal terminals 16 are thin plate-like terminals which are mounted or adhered to opposite sides of a tongue portion 22 of connector housing 14. It can be seen in FIG. 3 that wire management module 18 receives and positions electrical wire 12 so that a pair of signal conductors 24 of the wire are in proper position for termination to signal terminals 16 on opposite sides of tongue portion 22 of connector housing 14. Electrical wire 12 also includes a ground conductor 26 for purposes described below.

Figure 4:
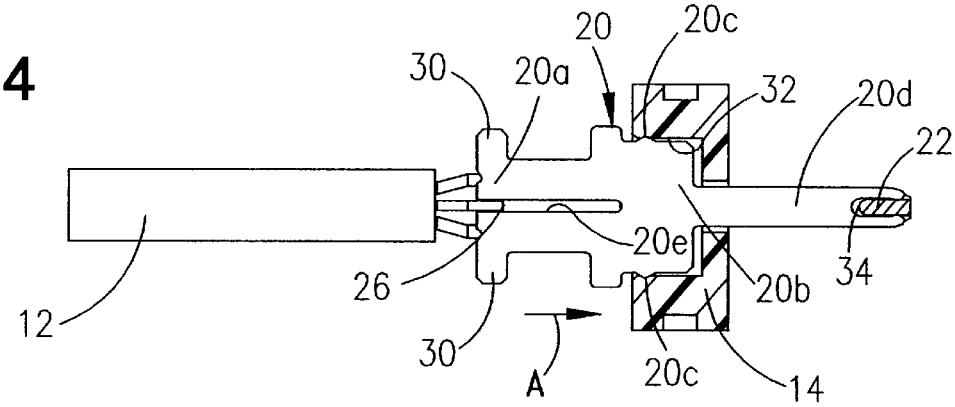
FIG. 4 is a section similar to that of FIG. 3, but with the wire management module removed and showing one of the ground terminals terminated to an electrical wire and inserted into the rear of the connector housing.

FIG. 4 shows the configuration of one of the ground terminals 20. The ground terminals alternate with signal terminals 16 along the width of the connector assembly as seen best in FIG. 2. The depiction of FIG. 4 is somewhat unrealistic in that the dielectric body of terminal module 18 (FIG. 3) has been removed to facilitate a clear depiction of the configuration of each of the ground terminals 20.

Specifically, each ground terminal 20 as shown in FIG. 4 is a stamped metal component having a T-shaped rear section 20*a* defining oppositely directed ears 30. The ground terminal has a front retention section 20*b* formed with teeth 20*c* at opposite edges thereof. In assembly, ground terminals 20 are press-fit into a plurality of terminal-receiving slots 32 in the rear face of connector body 14. The composite retention of the ground terminals within slots 32 effectively mounts the entire wire management module 18 to the connector housing without using any extraneous mounting components other than the ground terminals themselves. A contact portion 20*d* projects forwardly of each ground terminal 20 and is disposed within a slot 34 within tongue portion 22 of the connector housing. Finally, the ground conductor 26 of a respective one of the electrical wires 12 is terminated, as by soldering, to ground terminal 20. This can be facilitated by positioning the ground conductor within a groove 20*e* in the ground terminal.

Wire management module 18 includes a dielectric body, generally designated 38, as seen in FIGS. 1 and 2. The dielectric body both mounts ground terminals 20 and positions electrical wires 12. Dielectric body 38 is a two-part structure formed of two identical or hermaphroditic parts or body halves 40.

Figure 5:
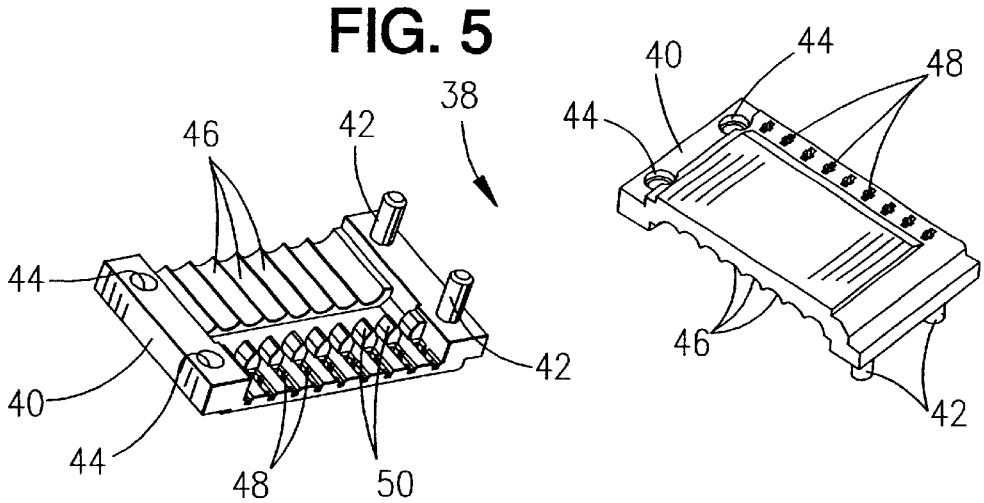
FIG. 5 is an exploded perspective view of the two-part dielectric body of the wire management module.

The two halves 40 of dielectric body 38 of wire management module 18 are shown in FIG. 5. Each body half includes a pair of posts 42 which are press-fit or staked into a pair of holes 44 in the other body half to hold the halves together. The inside surface of each body half 40 includes a plurality of opposing, generally parallel grooves 46 which properly position electrical wires 20. The inside surfaces also have opposing lips 50. The lips extend from the inside surface adjacent the beginning portion of the exposed conductor wires 24 and form a dielectric barrier between the wires to help control the impedance and capacitance. Each body half 40 includes a row of slots 48 which receive ears 30 (FIG. 4) of ground terminals 20. Each body half 40 includes a plurality of partitions 50 which abut each other and which separate and space the signal conductors 24 of the electrical wires.

In assembly of body halves 40 of wire management module 18, the posts 42 of one body half are inserted into holes 44 of the other body half with a press-fit, or the posts can be staked to permanently fix the body halves together. When the body halves are assembled, grooves 46 on the inside surfaces thereof receive, position and clamp electrical wires 12 therebetween in order to facilitate managing the electrical wires and the respective signal and ground conductors thereof. In addition, when the body halves are assembled, opposing ears 30 (FIG. 4) of ground terminals 20 are inserted into slots 48 which extend through each body half. This not only mounts and properly orients the ground terminals, but the ground terminals are clamped and locked between the two body halves. The resulting subassembly is a unique wire management module that includes dielectric body 38 (comprising body halves 40) integral with ground terminals 20. With electrical wires 20 being clamped by the wire management module, ground conductors 26 of the electrical wires are easily terminated to the ground terminals. On the other hand, the ground conductors are terminated (soldered) to the ground terminals prior to clamping the wires and the ground terminals between the body halves. This entire subassembly is easily assembled to connector body 14 by inserting retention sections 20*b* (FIG. 4) into terminal-receiving slots 32 in the rear face of connector body 14, in the direction of arrow "A" (FIG. 4). The wire management module now has properly positioned the electrical wires while providing an opening 52 between housing 14 and wire management module 18 for access by an appropriate device needed to create an electrical joint between the signal conductors 24 and signal terminals 16 as seen in FIG. 3. By using ground terminals 20 as the mounting means between the wire management module and the connector housing, all extraneous mounting means which add costs and require additional valuable space on the connector assembly have been eliminated. In addition, by having a wire management module which is independent of the connector housing, the dielectric components are very easily molded and avoids the complicated molding problems of the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for terminating a plurality of electrical wires, comprising:

a non-conductive connector housing mounting a plurality of first conductive terminals;

a wire management module including a non-conductive body mounting a plurality of second conductive terminals, and means on the body for retaining a wire and for positioning a plurality of first electrical wire conductors and for positioning a plurality of second electrical wire conductors for termination to the second conductive terminals; and complementary interengaging means between the connector housing and the second conductive terminals for mounting the wire management module to the connector housing with the first electrical wire conductors in position for termination to the first conductive terminals.

2. The electrical connector assembly of claim 1 wherein said first conductive terminals comprise signal terminals and said second conductive terminals comprise ground terminals.

3. The electrical connector assembly of claim 1 wherein said connector housing includes a plurality of terminal-receiving slots into which said second conductive terminals are press-fit whereby at least one of said first electrical wire conductors is located over a respective one of said first conductive terminals under an opening between the housing and the wire management module.

4. The electrical connector assembly of claim 1 wherein the non-conductive body of said wire management module comprises a two-part structure for clamping the electrical wires therebetween.

5. The electrical connector assembly of claim 4 wherein two parts of the body include opposing grooves for positioning the electrical wires therewithin.

6. The electrical connector assembly of claim 1 wherein said second conductive terminals are stamped metal components including ears interengaged in slots in the non-conductive body of the wire management module.

7. The electrical connector assembly of claim 1 wherein the non-conductive body of said wire management module comprises a two-part structure for clamping the second conductive terminals therebetween.

8. The electrical connector assembly of claim 7 wherein said second conductive terminals are stamped metal components including T-shaped sections defining opposing ears interengaged in slots in the two parts of the dielectric body.

9. An electrical connector assembly for terminating a plurality of electrical wires, comprising:

a non-conductive connector housing mounting a plurality of signal terminals and including a plurality of ground terminal-receiving slots;

a wire management module including a two-part non-conductive body clamping a plurality of ground terminals therebetween, two parts of the dielectrical body positioning and clamping the electrical wires therebetween; and means on the ground terminals for mounting the wire management module to the connector housing with the electrical wires in position for termination to the signal terminals.

10. The electrical connector assembly of claim 9 wherein the two parts of the body include opposing grooves for positioning the electrical wires therewithin.

11. The electrical connector assembly of claim 9 wherein said ground terminals are stamped metal components including ears interengaged in slots in the two-part dielectric body of the wire management module.

12. The electrical connector assembly of claim 11 wherein the stamped ground terminals include T-shaped sections defining said ears interengaged in said slots in the two parts of the dielectric body.

* * * * *